United States Patent [19]

Jelsma

[11] Patent Number: 4,928,767

[45] Date of Patent: May 29, 1990

[54] METHOD AND APPARATUS FOR SETTING AND RETRIEVING A DEFLECTION TOOL

[75] Inventor: Henk H. Jelsma, Spring, Tex.

[73] Assignee: Baroid Technology, Inc., Houston, Tex.

[21] Appl. No.: 344,019

[22] Filed: Apr. 27, 1989

Related U.S. Application Data

[63] Continuation-in-part of Ser. No. 174,083, Mar. 28, 1988, abandoned.

[51] Int. Cl.[5] ..... E21B 7/08; E21B 23/00

[52] U.S. Cl. ..... 166/377; 166/117.6; 166/378

[58] Field of Search ..... 166/117.6, 117.5, 381, 166/382, 301, 83, 98, 125, 237, 240, 377, 378; 175/78–83

[56] References Cited

U.S. PATENT DOCUMENTS

| | | | |
|---|---|---|---|
| 2,298,706 | 10/1942 | Kothny | 175/82 X |
| 2,331,293 | 10/1943 | Ballard | 175/82 X |
| 2,401,893 | 6/1946 | Williams, Jr. | 175/83 X |
| 2,586,878 | 2/1952 | Staton | 175/83 |
| 2,839,270 | 6/1958 | McCune et al. | 166/117.6 X |
| 3,308,886 | 3/1967 | Evans | 166/240 X |

*Primary Examiner*—Stephen J. Novosad

*Attorney, Agent, or Firm*—Browning, Bushman, Anderson & Brookhart

[57] ABSTRACT

A drill string includes an anchor type set down bit threadedly connected to the deflection section. Threadably coupled above the deflector section is a shear and retrieve sub having three equally spaced latch pin receptacles and three equally spaced shear pin holes. Above the shear and retrieve sub is a beveled guide section for receiving a retrieving setting tool having a tapered end sized to be inserted within the beveled guide section. The shear and retrieve section has three equally spaced latch pin mechanisms and three equally spaced shear pins. A pickup cross over sub is coupled into the top of the shear and retrieve sub and has an enlarged diameter ring which acts to limit the downward movement of the shear and retrieve section within the interior of the beveled guide and retrieving setting tool sections. A drill string operating from the earth's surface is coupled into the pickup cross-over sub which allows the entire assembly to be lowered into an earth borehole to a desired depth. By applying additional set down weight through the drill string, the shear pins are sheared and the deflector section remains at the desired depth in the borehole. In the retrieving mode, the retrieving setting tool is run back into the earth borehole on the drill string to latch with the shear and retrieve section to enable the retrieval of the deflector section.

5 Claims, 5 Drawing Sheets

METHOD AND APPARATUS FOR SETTING AND RETRIEVING A DEFLECTION TOOL

BACKGROUND OF THE INVENTION

1. Related Application

This application is a Continuation-In-Part of my U.S. Pat. application Ser. No. 07/174,083, filed Mar. 28, 1988, now abandoned.

2. Field of the Invention

The present invention relates, generally, to a method and apparatus for setting and retrieving a deflection tool useful in high angle, kick off work in vertical or inclined well bores, and specifically, to method and apparatus for multiple setting and retrieval of such deflection tools.

3. Description of the Background

The prior art has recognized the need for setting deflection tools, sometimes referred to as deflection shoes, in earth boreholes to allow drill strings to be deflected off at an angle from the longitudinal axis of the borehole. For example, in my copending U.S. Pat. application Ser. No. 156,831, filed Feb. 17, 1988, entitled "Method and Apparatus for Drilling a Curved Borehole", incorporated herein by reference, I describe the use of such a deflection shoe.

The prior art systems to set deflection shoes are not easily retrievable, if at all. Thus, in using such prior art systems, the deflection shoe would typically be run into the well bore on a drill string, and when the deflector shoe is at the right depth, it would be anchored and left in the borehole.

Those skilled in the art will recognize, also, that it is sometimes desirable to kick off several vertically spaced deviated well bores from the same original well bore. This, of course, is quite difficult when using deflection shoes which cannot be easily retrieved from the well bore.

It is therefore the primary objective of the present invention to provide a method and apparatus for multiple setting and retrieval of a deflection tool in an earth borehole.

This and other objects, features and advantages of the present invention will be readily appreciated from a reading of the detailed description of the invention following hereinafter.

SUMMARY OF THE INVENTION

The objects of the invention are accomplished, generally, by the provision of methods and apparatus used in running a retrievable tool into an earth borehole until a portion of the retrievable tool rests against a deflector section residing in the earth borehole, rotating the retrievable tool to thereby latch up the retrievable tool to the deflector section and lifting up the retrievable tool to thereby retrieve the deflector section from the earth borehole.

As an additional feature of the invention, the deflector section is set in the earth borehole by methods and apparatus used in connecting a deflector section to a retrievable section through the use of at least one shear pin; running the connected deflector and retrievable sections down the borehole, to thereby set the deflector section at the desired depth in the earth borehole; setting down additional weight on the retrievable section to shear the said at least one shear pin: and lifting up the retrievable section, leaving the deflector section at the desired depth in the borehole.

DESCRIPTION OF THE PREFERRED EMBODIMENT

Figure 1:
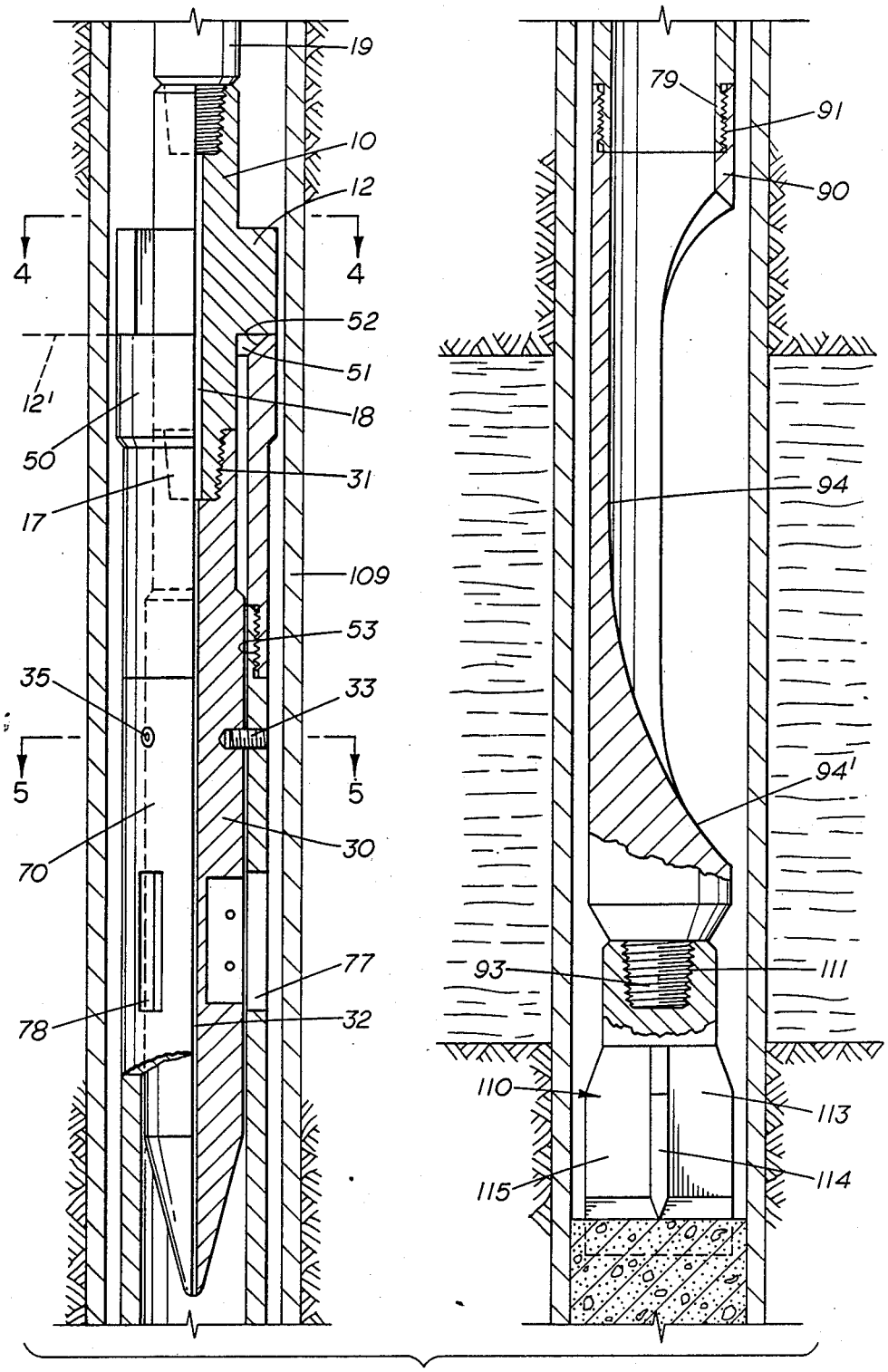
FIG. 1 is an elevational view, partially in cross-section, of the overall apparatus according to the present invention.

Referring now to FIG. 1 of the drawings, the pickup cross-over sub 10 is threadedly connected into one end of the retrievable setting tool 30. The sharp nosed end of the retrievable setting tool 30 has entered one end of the guide section 50, the other end of the guide section 50 threadedly engaging one end of the shear and retrieve section 70. The other end of the shear and retrieve section 70 threadedly engages one end of the deflector section 90. The other end of the deflector section 90 threadably engages the setting bit 110. The operation of the system illustrated in FIG. 1 will be explained in greater detail hereinafter.

Figure 4:
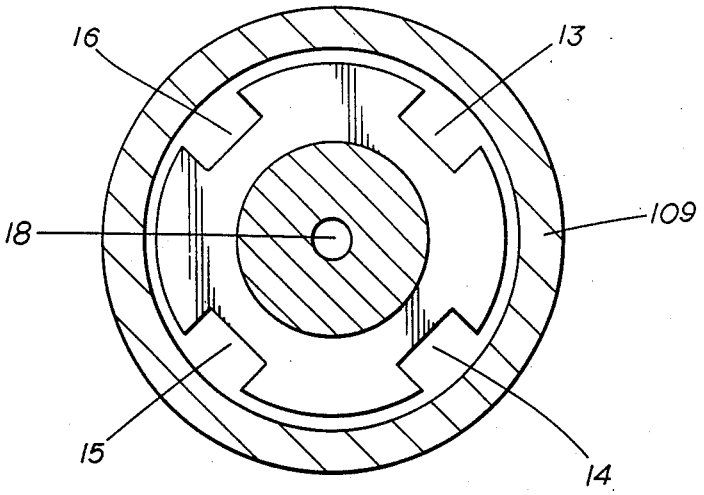
FIG. 4 is a cross-sectional view taken along the lines 4—4 of FIG. 1.

Referring now to FIGS. 1 and 4, the pickup cross-over sub 10 is now described in greater detail. The upper box end 11 threadably engages the pin end of a conventional orienting sub 19 which will enable the surface operator to orient the deflection shoe in the proper direction and orientation as is well known in the art. Attached to the orienting sub 19 will be a drill string (not illustrated) used for lowering the system into an earth borehole and for retrieving the system. Spaced along the longitudinal axis of the sub 10 is an enlarged diameter ring 12 having four flow channels 13, 14, 15 and 16, as best illustrated in FIG. 4. The lower pin end 17 is threaded and threadably engages the upper box end of the retrievable setting tool 30. A flow channel 18 positioned coaxially with the longitudinal axis of the sub 10 allows drilling fluid to be pumped through the sub 10. The flow channels 13, 14, 15 and 16 allow the drilling fluid to pass through the annulus between the system equipment described herein and the casing 109 on the return trip of the drilling fluid to the earth's surface.

Figure 5:
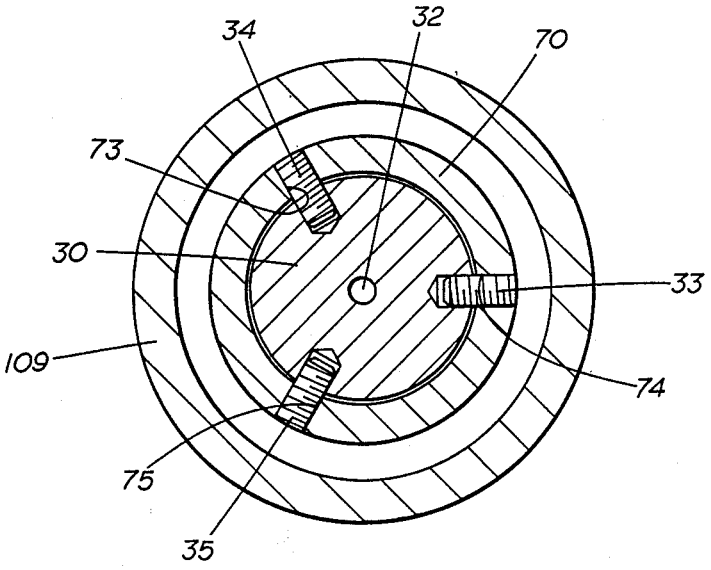
FIG. 5 is a cross-sectional view taken along the lines 5—5 of FIG. 1.

Referring further to FIG. 1, the retrievable setting tool 30 is illustrated in greater detail. The box end 31 has an internally threaded connection for threadably engaging the pin end 17 of the pickup cross-over sub 10. A central flow passage 32, coaxial with the longitudinal axis of the retrievable setting tool 30, extends along the entire length of the body of the tool 30. Three shear pins 33, 34, and 35, as best seen in FIG. 5, are equally spaced about the perimeter of the body of the tool 30 and are thus spaced 120° apart. Three latch pin mechanisms 36, 37 and 38 are also equally spaced about the perimeter of the body of the sub 30 and are also spaced 120° apart.

Referring further to FIG. 1, the beveled guide sub 50 is illustrated in greater detail. The one end 51 is enlarged to accept the sharp nosed end of the retrieving and setting tool 30. The interior of the guide sub 50 is beveled down at 45° to a lesser diameter commencing at the beveled face 52. At the end opposite the open end 51 is a box end 53 having female threads threadably engaging the pin end of the shear and retrieve section 70.

Referring further to FIG. 1, the deflector section 90 is illustrated in greater detail. The box end 91 has female threads threadedly receiving the pin end threads of the section 70. The pin end 93 threadedly engages the box end of the setting bit 110. The lower surface 94 begins a curved build up above half way along the length of the deflector section. In the preferred embodiment of the invention, the curved surface 94' builds up at the rate of one degree per foot. However, those skilled in the art will recognize that the slightly curved face 94' is designed for each job based upon the desired build up rate.

Referring further to FIG. 1, the setting bit 110 has a box end 111 with female threads 112 threadedly receiving the pin end 93 of the shear and retrieve section 90. The bit has four blades 113, 114, 115 and 116, blade 116 not being illustrated.

Figure 3:
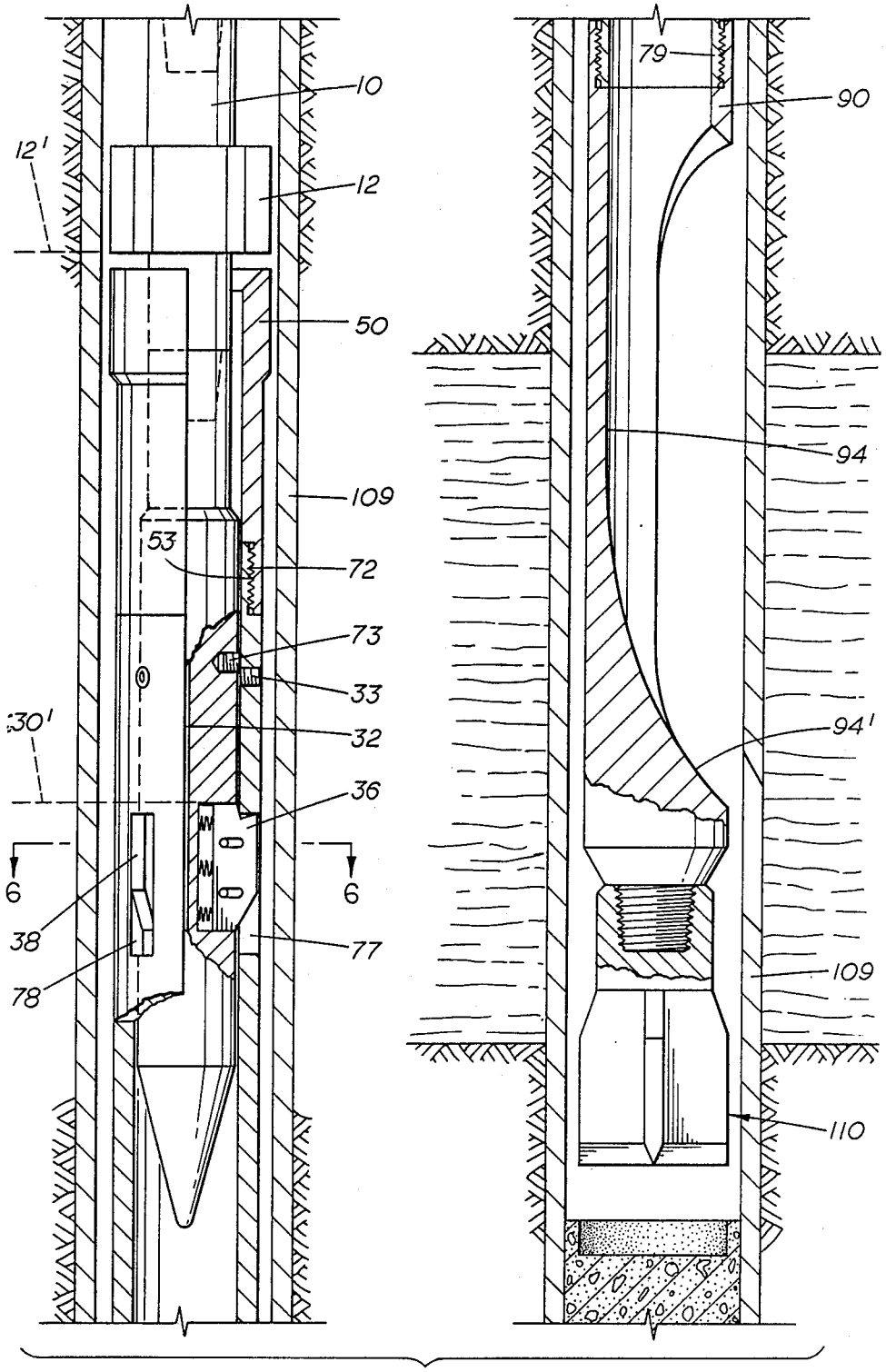
FIG. 3 is an elevated view, partially in cross-section, of the apparatus of FIG. 1, in its retrieval mode.
Figure 6:
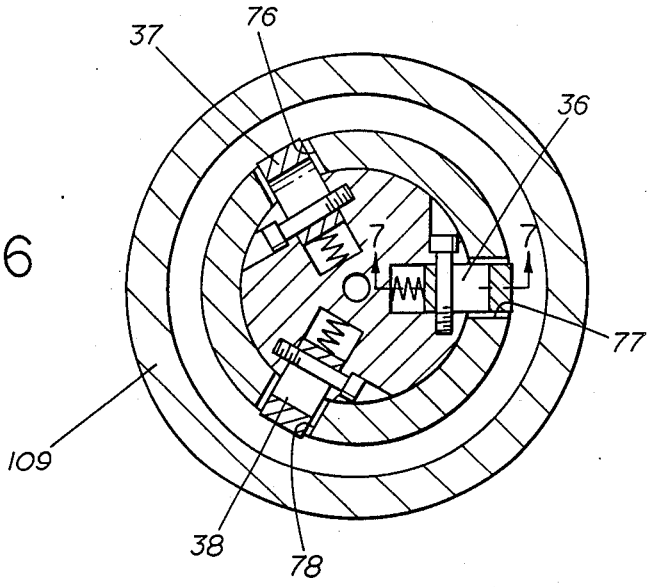
FIG. 6 is a cross-sectional view taken along the lines 6—6 of FIG. 3.

Referring now to FIG. 3, the shear and retrieve section 70 is illustrated in greater detail. The pin end 71 has male threads 72 threadably engaging the threads 53 of the guide section 50. Three shear pin holes 73, 74 and 75, best shown in FIG. 5, are equally spaced around the perimeter of the body of the shear and retrieve section 70, being spaced 120° apart to exactly coincide with the spacing of the shear pins 33, 34 and 35, also illustrated in FIG. 5. Spaced from the shear pin holes 73, 74 and 75 along the longitudinal axis of the shear and retrieve section 0 are three latch pin receptacles 76, 77 and 78, shown also in FIG. 6, which are equally spaced around the perimeter of the body of the section 70, being 120° apart, to coincide with the spacing of the latch pin mechanisms 36, 37 and 38. The pin end 79 has male threads threadably engaging the box end of the deflector section 90. The latch pin receptacles 76, 77 and 78 are sized to allow the latch pin mechanisms 36, 37 and 38 to enter these receptacles during the retrieval operation described hereinafter.

Figure 7:
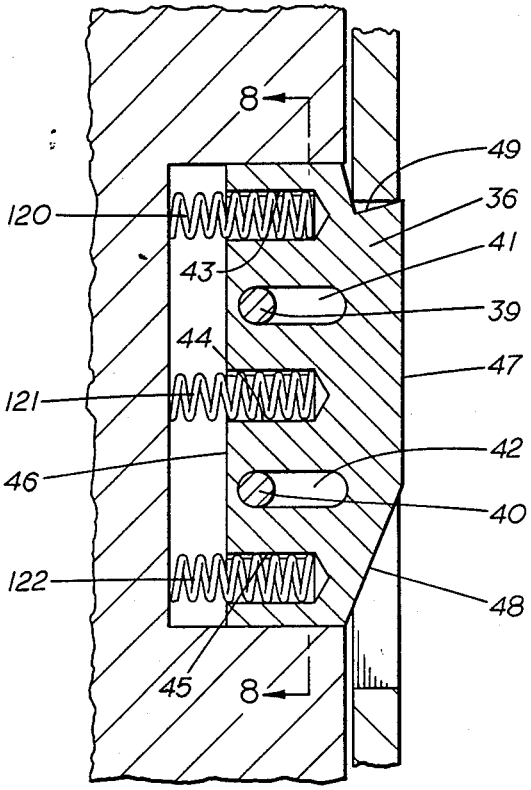
FIG. 7 is a cross-sectional view taken along the lines 7—7 of FIG. 6, illustrating the latch pin mechanism of the present invention.
Figure 8:
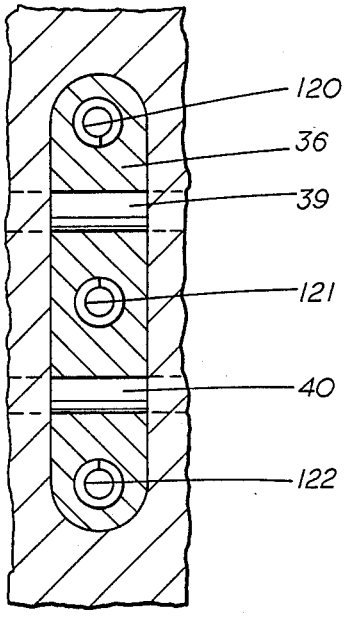
FIG. 8 is an end view of the latch pin mechanism illustrated in FIG. 7.

The latch pin mechanisms 36, 37 and 38 are spaced along the longitudinal axis of the tool 30 from the plane of the shear pins 33, 34, and 35. Each of the latch pin mechanisms 36, 37 and 38 is connected to the body of the tool 30 by a pair of bolts. For example, the latch pin mechanism 36 illustrated in FIG. 7, is attached to the body of the tool 30 by the bolts 39 and 40. As is best shown in FIG. 7, the bolts 39 and 40 are placed within the oval shaped receptacles 41 and 42, respectively. Each of the latch pin mechanisms also has three springs 120, 121 and 123 which force the latch pin mechanisms outwardly from the body of the tool 30, the three springs being located in the spring receiving receptacles 43, 44 and 45. The surface 46 of the latch pin mechanism 36 is nearest to the interior of the body of the tool 30. The surface 47 is adapted to enter the latch receptacles illustrated in the shear and retrieve section 70. The surface 47 is beveled at one end 48 to allow ease of movement along the interior of the well bore. The other end 49 of the surface 47 is profiled with a negative rake to allow the surface 49 to engage the shell surrounding the receptacle 77 for the retrieval operation.

Referring again to FIGS. 1, 2 and 3, it should be appreciated that when the pickup cross-over sub 10 is threadably engaged with the retrieving and setting tool 30, there is a predetermined distance existing between the lower surface 12' of the ring 12 and the location 30' which coincides with the uppermost end of the latch pin mechanisms 36, 37 and 38. That same predetermined distance exists between the upper surface 50' of the guide section 50 and the location 70' which coincides with the upper end of the latch receptacles 76, 77 and 78. Thus, it should be appreciated that when the pickup cross-over sub 10 is fully and threadably engaged with the retrieving and setting tool 30, and the guide section 50 is threadably engaged with the shear and retrieval section 70, upon the insertion of the retrieving and setting tool 30 into the guide section 50 and the shear and retrieval section 70, the latch pin mechanisms are directly aligned, along the longitudinal axis of the string, with the latch pin receptacles located in the shear and retrieve section 70. Thus, when the retrieving and setting tool is lowered into the guide section and the shear and retrieve section, and the surface 12' sets down on the surface 50', the only thing required to cause the latch pin mechanisms to engage the latch pin receptacles is the rotation of the drill string.

Figure 2:
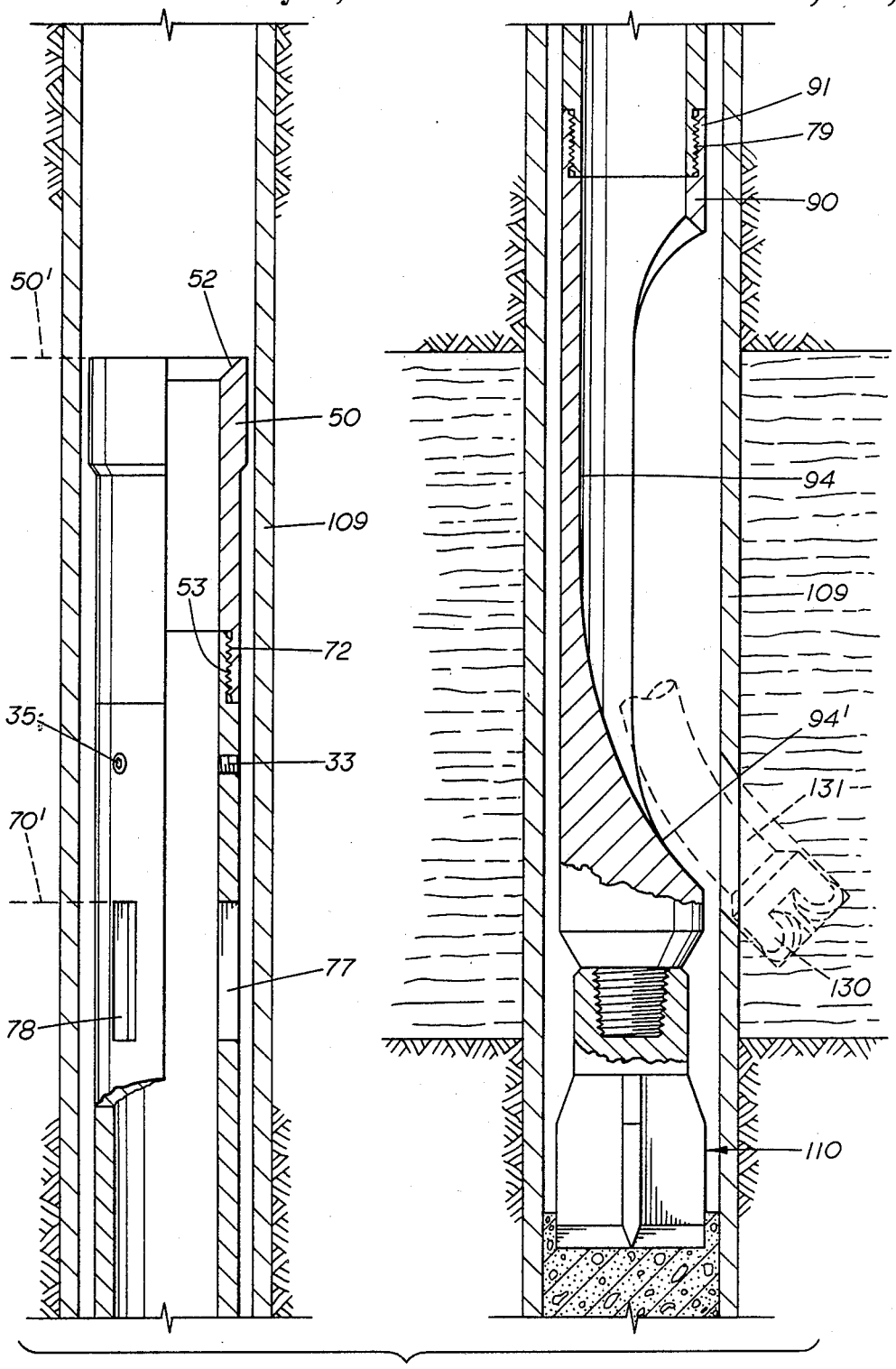
FIG. 2 is an elevated view, partially in cross-section, of the lower assembly, including the deflector section, located in place at the desired depth in the borehole.

Considering now the overall operation of the system illustrated in FIGS. 1–8, the setting mode will be described first. The setting bit 110 is first placed in a conventional bit breaker. Although FIG. 1 illustrates the deflector section 90 as threading directly into the setting bit, if desired, conventional spacing collars are positioned between the setting bit 110 and the deflector section 90. The spacing collars accomplish two things: the collars are used to increase the setting weight and are also used to place the deflection section 90 at the right depth within the well bore when the setting bit 110 is resting on a cement plug or some other bridge within the borehole. The guide section 50 is threaded into the shear and retrieve section 70 which in turn is threaded into the deflector section 90 which in turn is either threaded directly into the setting bit or through the spacing collars (not illustrated) into the setting bit 110. At this point, the spring loaded latch mechanisms are either removed from the shear and retrieve section 30, or alternatively, are disabled in a way that the latch pin mechanisms will not spring out. The drill string and orienting sub are threaded into the pickup cross-over sub 10 which in turn is threaded into the retrieving setting tool. The retrieving setting tool is then lowered into the guide section 50 and the shear and retrieve section 70 until the shear pins are oriented with respect to the shear pin holes in the shear and retrieve section 70. Depending on the weight involved, one or more of the shear pins 33, 34 and 35 will be inserted into the shear pin holes 73, 74 and 75 to tie the entire assembly together. A one inch shear pin typically requires about 35,000 lb. to shear. As is apparent to those skilled in the art, the number and the strength of the shear pins used will vary depending upon the particular job. Once the orienting sub has been aligned with the deflector section, the entire assembly is lowered into the well bore to a depth at which point the setting bit 110 comes into contact with the cement plug or other bridge located in the well bore. If desired, to get the desired depth, the setting bit can be used to drill a small distance, for example, one or two feet, into the cement plug. As soon as the deflector system is at the desired depth, and the assembly has been oriented in the desired direction, additional set down weight of the drill string is applied to shear the one or more shear pins. The retrieving and setting tool as well as the pickup cross-over sub are then withdrawn from the well on the lower end of the drill string. If desired, the drill pipe is rotated 60° prior to picking up the drill string. At this point, the guide section 50, the shear and retrieve section 70, the deflector system 90 and the setting bit 110 are on location at the desired depth, as illustrated in FIG. 2, to permit the drilling of an offset well along the curved surface of the deflector sub in a manner well known in the art. Also as illustrated in FIG. 2, a conventional window mill bit 130 connected into a drill string 131 is shown drilling off the surface 94' through the casing 109.

Referring now to the retrieval mode, the latch pin mechanisms will be installed in the retrieving and setting tool 30, or otherwise activated, and the pickup and cross-over sub 10 and the retrieving and setting tool 30 are lowered into the well on the drillstring to again enter the guide section 50 and the shear and retrieve section 70. As soon as the surface 12' makes contact with the surface 50' of the guide section, the latch pin mechanisms 36, 37 and 38 will be at the same depth as the latch receptacles 76, 77 and 78, i.e., they will then be in a common plane perpendicular to the longitudinal axis of each of the sections 30, 50 and 70, and the only thing needed at that point to latch up the system is to rotate the drill string such that the latch pin mechanisms enter the latch pin receptacles. By slowly rotating the drill string, the torque meter at the earth's surface will indicate a positive latch. By very slowly picking up the drill string, as illustrated in FIG. 3, the deflector section can be retrieved from the borehole. To facilitate the retrieval of the deflector section, drilling fluid circulation may be established in the same manner as is used in drilling a borehole to thereby clean up the deflection face prior to the pulling operation. Once the deflector system reaches the earth's surface, the apparatus described herein can again be used to reset the deflector section at any desired depth.

Thus, it should be appreciated that there has been illustrated and described herein a system which allows a deflector section to be set and retrieved as many times as desired. The latch type upper section comprised of the guide section 50 and the shear and retrieve section 70 can sit in the lower portion of the existing casing to bridge the open hole gap and provide a guide section to the drill bit which will be drilling off the curved surface 94' of the deflector section 90.

Moreover, it should be appreciated that because of the spacing between the ring 12 on the pickup cross-over sub 10 and the spring loaded latch mechanisms being matched with the spacing between the top of the guide section 50 and the latch pin receptacles, there is no need for the typical "search and probe" type of latching since the present system involves immediate latching with nothing required other than rotation of the string.

Obvious modifications to the foregoing preferred embodiment will occur to those skilled in the art from a reading of this specification. For example, the pickup cross-over sub 10 and the retrieving and setting tool can be built as a single apparatus. Likewise, the guide section 50, the shear and retrieve section 70 and the deflector section 90 can be constructed as a single apparatus without departing from the spirit of the invention. Moreover, by using a single latch pin mechanism and a single latch receptacle, the tool 30 will latch up to the shear and retrieve section 70 with no more than a single revolution of the tool 30.

What is claimed is:

1. A method for setting and retrieving a deflector section from an earth borehole, comprising:

connecting a deflector section to a retrievable section through the use of at least one shear pin;

running the connected deflector and retrievable sections down the borehole, to thereby set the deflector section at the desired depth in the earth borehole;

applying additional set down weight to the retrievable section to shear the said at least one shear pin, thereby leaving the deflector section at the desired depth in the borehole;

running the retrievable section, said retrieving section having at least one latch pin mechanism therein, back down the borehole to traverse the interior of the deflector section a predetermined distance:

causing the said at least one latch pin mechanism to enter at least one latch pin receptacle in said deflector section solely by rotating said retrievable section: and lifting said retrievable section to thereby retrieve said deflector section from the earth borehole.

2. In a method of setting and retrieving a deflector section from an earth borehole, wherein said deflector section has already been set in said borehole, the improvement comprising running a retrievable tool into the borehole until a portion of the retrievable tool rests against said deflector section, rotating said retrievable tool no more than one complete revolution, without picking up on said retrievable tool, to thereby latch up the retrievable tool to the deflector section; and lifting up the retrievable tool to thereby retrieve the said deflector section from the earth borehole.

3. A system for setting and retrieving a deflector section from an earth borehole, comprising:

a first assembly having first and second ends and a longitudinal axis between said first and second ends, wherein said second end comprises a deflector section, said first assembly including a cylindrical shell of a given internal diameter and said first end having at least one shear pin receiving hole in said shell and at least one latch pin receptacle in said shell;

a second assembly having first and second ends and a longitudinal axis between said first and second ends wherein the second end of said second assembly comprises a probe sized to fit within the said interior of said first assembly, said second assembly including at least one shear pin sized to fit said at least one shear pin receiving hole, and also including at least one spring-loaded latch pin mechanism sized to fit within the said at least one latch pin receptacle, said second assembly further comprising stop means to limit the travel of said probe within the interior of said first assembly, whereby said at least one latch pin mechanism is in the same plane as that of the said at least one latch pin receptacle, said plane being perpendicular to the longitudinal axis of each of the said first and second assemblies, whenever the travel of said probe is so limited.

4. The system according to claim 3 wherein said at least one shear pin comprises three shear pins equally spaced about the perimeter of the first assembly, and said at least one shear pin receiving hole comprises three shear pin receiving holes equally spaced about the perimeter of the second assembly.

5. The system according to claim 3 wherein said at least one latch pin mechanism comprises at least three latch pin mechanisms equally spaced about the perimeter of the first assembly, and the said at least one latch pin receptacle comprises three latch pin receptacles equally spaced about the perimeter of the second assembly.

* * * * *